US006253879B1

(12) United States Patent
Skalski et al.

(10) Patent No.: US 6,253,879 B1
(45) **Date of Patent: *Jul. 3, 2001**

(54) APPARATUS AND METHOD OF DETERMINING OVERSPEED OF AN ELEVATOR CAR

(75) Inventors: Clement Alexander Skalski, Avon; Alberto Vecchiotti, Middletown, both of CT (US)

(73) Assignee: Otis Elevator Company, Farmington, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/218,694

(22) Filed: Dec. 22, 1998

(51) Int. Cl.[7] ..... B66B 5/06
(52) U.S. Cl. ..... 187/287; 187/394
(58) Field of Search ..... 187/287, 288, 187/391, 394, 393

(56) References Cited

U.S. PATENT DOCUMENTS

| | | | | |
|---|---|---|---|---|
| 4,318,456 | * | 3/1982 | Lowry | 187/29 R |
| 4,662,481 | | 5/1987 | Morris et al. | 187/77 |
| 4,880,082 | * | 11/1989 | Kahkipuro et al. | 187/134 |
| 5,052,523 | | 10/1991 | Ericson | 187/89 |
| 5,065,845 | | 11/1991 | Pearson | 187/89 |
| 5,151,562 | * | 9/1992 | Fujita et al. | 187/134 |
| 5,223,680 | * | 6/1993 | Schmidt-Milkau et al. | 187/134 |
| 5,306,882 | * | 4/1994 | Gerwing et al. | 187/134 |
| 5,323,877 | | 6/1994 | Mori | 187/91 |
| 5,377,786 | | 1/1995 | Nakagawa | 187/276 |
| 5,393,941 | * | 2/1995 | Mizuno et al. | 187/293 |
| 5,487,450 | | 1/1996 | Gerber | 187/367 |
| 5,644,111 | * | 7/1997 | Cerny et al. | 187/393 |
| 5,648,644 | | 7/1997 | Nagel | 187/288 |
| 5,648,645 | | 7/1997 | Arpagaus et al. | 187/393 |
| 5,736,695 | * | 4/1998 | Hoepken | 187/394 |
| 5,883,345 | * | 3/1999 | Schonauer et al. | 187/394 |

FOREIGN PATENT DOCUMENTS

| | | |
|---|---|---|
| 0712804 | 5/1996 | (EP) . |
| 0543154 | 9/1997 | (EP) . |
| 0812796 | 12/1997 | (EP) . |
| 0856485 | 1/1998 | (EP) . |
| 0841282 | 5/1998 | (EP) . |
| 0662445 | 4/1999 | (EP) . |
| 3124688 | 5/1991 | (JP) . |
| 4246079 | 9/1992 | (JP) . |
| 4365771 | 12/1992 | (JP) . |
| 5147852 | 6/1993 | (JP) . |
| 5262472 | 10/1993 | (JP) . |
| 6255949 | 9/1994 | (JP) . |
| 8198543 | 8/1996 | (JP) . |
| 9040317 | 2/1997 | (JP) . |
| WO9842610 | 10/1998 | (WO) . |

OTHER PUBLICATIONS

Otis Invention Disclosure No. OT–4556 entitled Mechanical Resetting for Switch (Apolo Governor) dated Apr. 27, 1999.

* cited by examiner

*Primary Examiner*—Jonathan Salata

(57) ABSTRACT

An apparatus and method for determining the speed of an elevator car. A radar speed sensor (30) is provided determining the velocity of an elevator car (2). The speed sensor produces a signal which is processed by a processor (52) and compared to a threshold speed value by speed detection module (70). The speed detection module produces an overspeed signal (72) triggering the operation of actuator (34) and safety brake (26).

22 Claims, 3 Drawing Sheets

APPARATUS AND METHOD OF DETERMINING OVERSPEED OF AN ELEVATOR CAR

TECHNICAL FIELD

This invention relates to an elevator speed determining and monitoring device and method. More specifically, this invention relates to a device, and a method for its use, which determines an overspeed condition of an elevator car and provides an electronic signal corresponding thereto.

BACKGROUND OF THE INVENTION

Elevators are presently provided with a plurality of braking devices which are designed for use in normal operation of an elevator, for example to hold the elevator car in place where it stops at a landing, and which are designed for use in emergency situations such as arresting the motion of a free-falling elevator car.

One such braking device is provided to slow an overspeeding elevator car, that is one which is travelling over a predetermined rate. Such braking devices typically employ a governor device which triggers the operation of safeties. In such elevator systems a governor rope is provided which is looped over a governor sheave at the top of the hoistway and a tension sheave is at the bottom of the hoistway and is also attached to the elevator car. When the governor rope exceeds the predetermined rate of the elevator car the governor grabs the governor rope, pulling two rods connected to the car. The rods pull two wedge shaped safeties which pinch the guide rail on which the elevator car rides thereby braking and slowing the elevator car.

The device and method employed in determining an overspeed condition of an elevator car is important to the proper working of the safety braking system. In conventional systems the speed of an elevator car may be monitored through the governor rope, governor sheave, tension sheave or mechanical linkages which operate the safeties. For instance, the governor sheave described above typically employs a centrifugal device which when an overspeed condition is reached engages a brake producing drag on the governor rope and thereby activating the safeties. The governor rope rotates a governor, at a rate of rotary speed that relates to the linear speed of the elevator car. The governor has fly weights that move outwardly with increasing speed as a result of increasing centrifugal force. When the elevator exceeds a predetermined speed the fly weights trip an overspeed switch which allows a set ofjaws to grip the rope and activate the safeties. In other systems a tachometer is attached to a secondary cable attached to the sheave and employed to monitor an overspeed condition of the elevator car and activate the safeties.

A disadvantage of the prior art systems is the wear which occurs to the rope and governor systems. The greatest problem with this type of wear is that it is often visually undetectable. In addition when an overspeed condition occurs the elevator is required to be taken out of service until a mechanic is available to reset the governor unit and release the safeties.

Another disadvantage of a governor rope assembly is the required maintenance and hoistway space required. The governor rope, sheaves and linkages must be periodically cleaned, lubricated and replaced. All maintenance requirements are considered burdensome to those skilled in the art, and therefore an undesirable feature. As such there is a need to eliminate a governor rope assembly and a further need for an accurate device and method to monitor and determine an overspeed condition of an elevator car without a governor rope assembly. In light of this need there exists a further need for an accurate, non-contact, continuous and instantaneous device and method of detecting an overspeed condition of an elevator.

DISCLOSURE OF THE INVENTION

Therefore, it is an object of the present invention to provide an improved method and apparatus for detecting an overspeed condition of an elevator car.

In accordance with the present invention, an overspeed condition of an elevator is detected by determining the speed of the elevator using a radar speed sensor. The speed sensor continuously monitors the speed and direction of an elevator in an accurate, noncontact continuous and instantaneous manner without using a rope assembly governor system of the prior art. In an embodiment of the present invention the speed sensor is mounted to an elevator car and directs a transmitted signal at a portion of the hoistway or rail. In another embodiment the speed sensor is mounted to the ceiling or bottom of the hoistway and directs the transmitted signal at the elevator car. The speed sensor receives a return signal and produces a speed signal indicative of the speed and direction of the elevator car. The speed signal is received by a microprocessor which compares the speed signal to a predetermined threshold value corresponding to an overspeed condition. When an overspeed condition exists the microprocessor produces an overspeed signal enabling a safety brake system to slow the elevator.

The foregoing and other objects, features and advantages of the present invention will become more apparent in light of the following detailed description of the invention, as shown in the accompanying drawings.

BEST MODE FOR CARRYING OUT THE INVENTION

Figure 1:
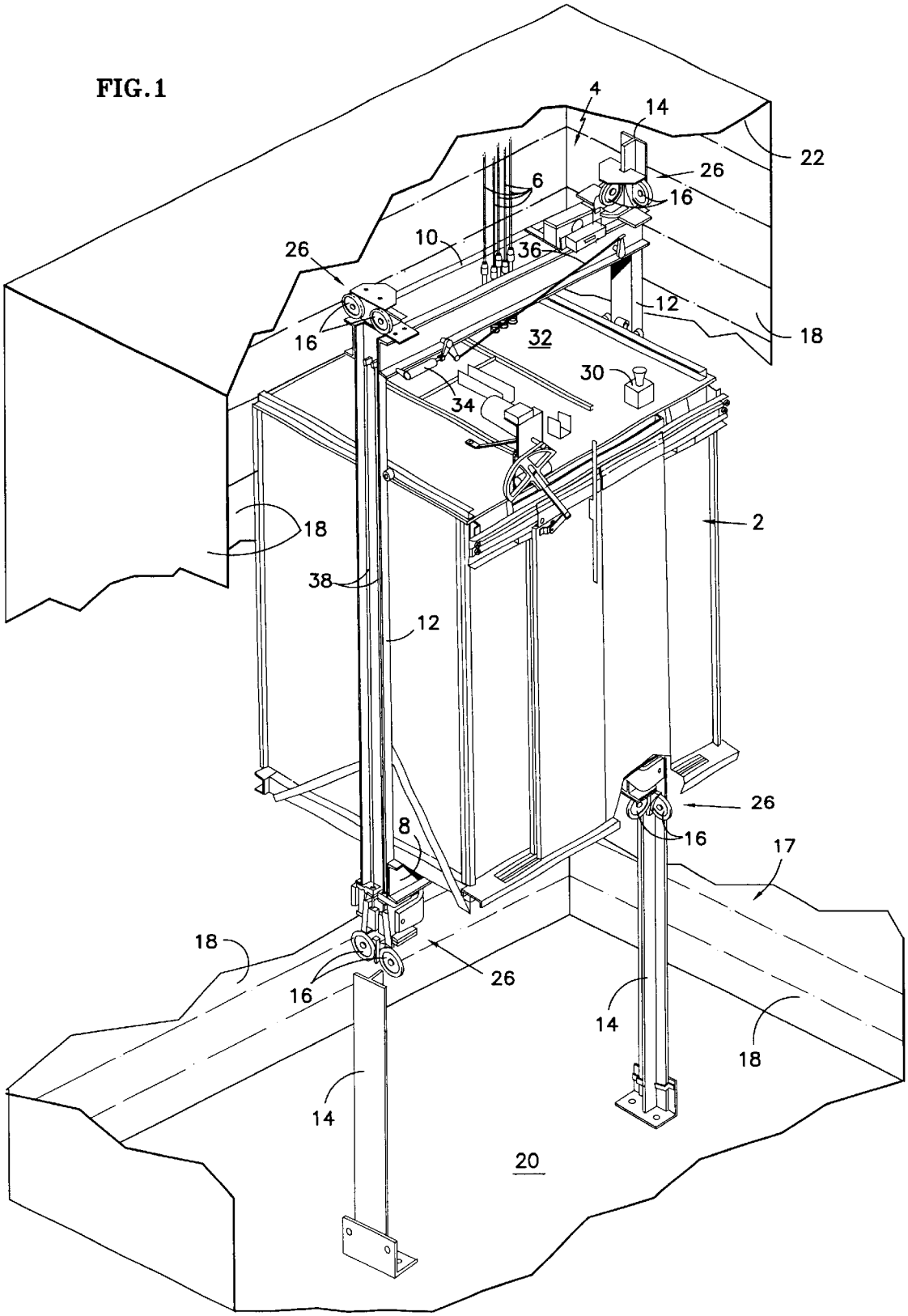
FIG. 1 is an isometric view in partial section of an elevator in a hoistway employing a speed sensor of the present invention.

FIG. 1 shows an elevator car 2 of present invention sitting on a frame 4 which hangs from, and is moved by, ropes 6. The car frame 4 includes a safety plank 8 on which elevator car 2 sits, two uprights 12 on either side of car frame 4 and a cross head 10 to which elevator ropes 6 are directly attached. On either side of car frame 4 is a guide rail 14 on which car frame 4 rides within rollers 16. Elevator car 2 is moved vertically within hoistway 17 defined by walls 18, bottom 20, and ceiling 22 by a motor (not shown).

The elevator car 2 of the present invention does not employ the governor rope assembly of the prior art to trigger a safety brake system in the event of an overspeed condition. In accordance with the present invention a radar speed sensor 30 is shown mounted to the top surface 32 of elevator car 2 and projected toward ceiling 22 of hoistway 36. As will be more fully explained herein below, radar speed sensor 30 sends out continuous electromagnetic signals which are reflected off of ceiling 22. Sensor 30 continuously detects return signals and includes a transceiver which together with processing devices calculates the velocity and direction of travel of elevator car 2 therefrom. When an overspeed condition exists, sensor 30 produces an output signal which is ultimately used to trigger a safety brake system. In the example shown in FIG. 1, the output signal triggers actuator 34 and through a system of linkages 36, translate rods 38, located on either side of elevator car 2, which in turn actuate safety brakes 26 applying a braking force against rails 14. Actuator 34 may comprise an air cylinder, a hydraulic cylinder, an electric motor, an electric actuator or an equivalent device capable of translating linkage system 36. Speed sensor 30 permits the actuation of the safety brake system when an overspeed condition is sensed in both the upward travel and the downward travel of elevator car 2 as a set of safety brakes 26 are mounted at the top of elevator car 2 to stop the car in the downward direction and a set of safety brakes 26 are located at the bottom of the car to stop the car in the upward direction.

Figure 2:
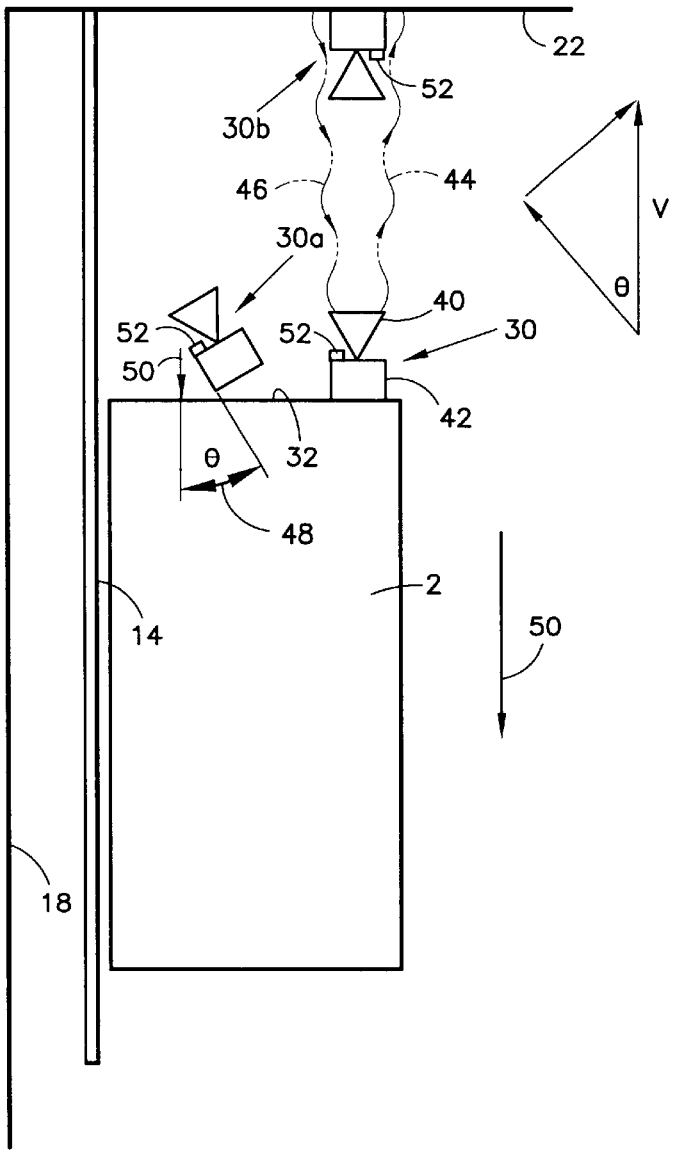
FIG. 2 is a diagrammatic side view of an elevator employing a speed sensor of the present invention.

Referring next to FIG. 2 three different embodiments of the present invention are disclosed. In one embodiment speed sensor 30 is mounted to the top of elevator car 2 and is comprised of a radar oscillator transceiver, such as a Doppler radar or an equivalent thereof, which includes an antenna 40 and an oscillator receiver 42 coupled thereto. Antenna 40 is shown as a horn type antenna but may also comprise a planar array, or patch, antenna or other suitable type antennas. Oscillator receiver 42 may comprise a commercially available type oscillator receiver such as a model MA86849-M01 or MA86843-M05 supplied by MIA-COM coupled to antenna 40. The use of a dual channel type oscillator receiver permits measurement of velocity and direction of travel elevator car 2 allowing for overspeed control in the up direction and the down direction. Although speed sensor 30 is shown as an integral Doppler radar unit, it is done so by way of example and not limitation. Accordingly it is within the scope of the present invention that speed sensor 30 may alternatively comprise a separate transmitter, antenna and receiver as well as similar equivalents. In addition, it is within the scope of the present invention that speed sensor 30 may comprise other types of radar such as a VORAD ETV-200 sensor manufactured by Eaton, a nonreflecting radar, and transponder units.

As discussed herein above speed sensor 30 is a radar device which, through antenna 40, transmits continuous electromagnetic signals represented by 44. The transmitted signals 44 are reflected off of ceiling 22 and return signals represented by 46 are received by antenna 40. The reflected signals 46 carry information on the velocity of car 2 relative to the reflected surface, ceiling 22.

A second embodiment of shown in FIG. 2 is one where speed sensor 30*a* is obliquely mounted on elevator car 2 at an angle θ represented by 48, relative to the velocity vector of elevator car 2 represented by 50. Speed sensor 30*a* is positioned such that the continuous magnetic signals are transmitted toward and reflected off of either rail 14 or wall 18. Similar to speed sensor 30, speed sensor 30*b* is mounted to ceiling 22 such that the continuous magnetic signals are transmitted toward and reflected off of elevator car 2. In addition, it is within the scope of the present invention that speed sensor 30 may be mounted to the floor of elevator car 2 such that the continuous magnetic signals are transmitted toward and reflected off of the bottom 20 of the hoistway 36, rail 14 or wall 18 and further that speed sensor 30 may be mounted to the bottom 20 of the hoistway 36 such that the continuous magnetic signals are transmitted toward and reflected off the bottom of the hoistway.

Figure 3:
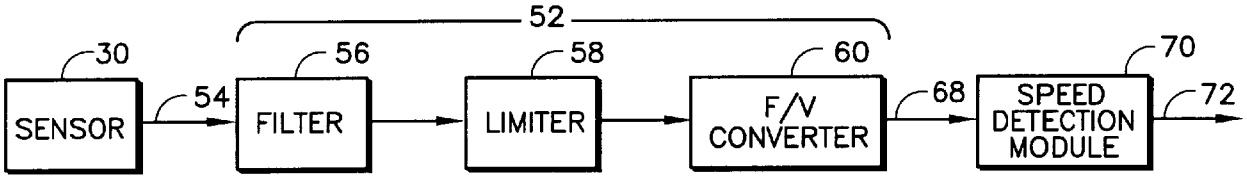
FIG. 3 is a schematic diagram of a speed sensor and processor according to the present invention.
Figure 4:
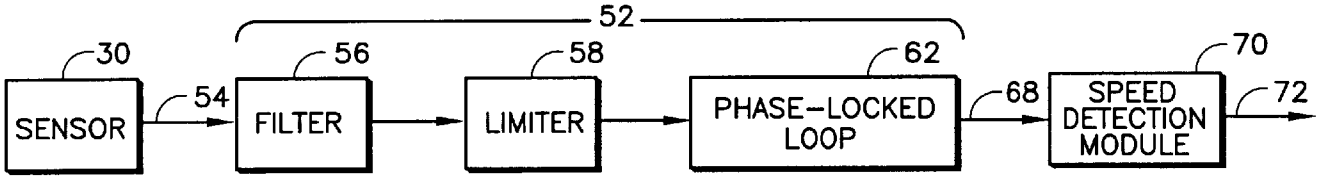
FIG. 4 is a schematic diagram of an alternative embodiment speed sensor and processor according to the present invention.
Figure 5:
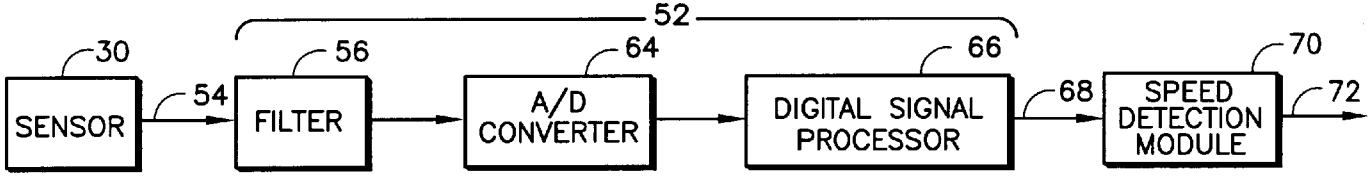
FIG. 5 is a schematic diagram of another alternative embodiment speed sensor and processor according to the present invention.

Once return signal 46 is received by speed sensor 30, oscillator transceiver 42 outputs a speed signal $f_{out}$, represented by 68 in FIGS. 3, 4 and 5, which includes a frequency which is proportional to the velocity, $v_{ca}$, of elevator car 2 according to the following relationship:

$$f_{out}=\cos(\theta)*2*v_{car}*f_{rad}/v_{light}$$

wherein: $v_{light}$=the velocity of light=$3*10^8$ m/s;

$f_{rad}$=radiation frequency=24.125 GHz; and

θ=angle 48 between sensor axis and velocity vector

Reduction of the relationship yields:

$$f_{out}=160.8*v_{ca}*\cos(\theta)$$

Angle 48 of speed sensors 30 and 30*b* is 0.0 degrees which yields a scale factor for the output signal of oscillator transceiver 42 equal to 160.8 Hz/(m/s). A scale factor for speed sensor 30*a* would be dependant on the value of the mounting angle 48.

Return signal 46 is comprised of a number of unwanted frequencies considered to be scatter and noise as well as a peak Doppler frequency, the average of which corresponds to the speed of the elevator car 2. Some of the unwanted frequencies are produced as a result of the fact that transmitted signal 44 diverges as it is emitted from antenna 40 into a spread, referred to as a viewing angle. The viewing angle causes a corresponding spreading of the frequencies to occur in return signal 46. Other unwanted frequencies in transmitted signal 44 may be caused by vibration in the mounting of speed sensor 30 or interruption of the signal by an obstruction, again translating into unwanted frequencies in return signal 46. In addition, a small portion of transmitted signal 44 is received directly by the antenna 40 prior to reflection and together with variations in the reflected surface (22, 14, or 18) may cause noise or other unwanted signals within return signal 46.

Figure 6:
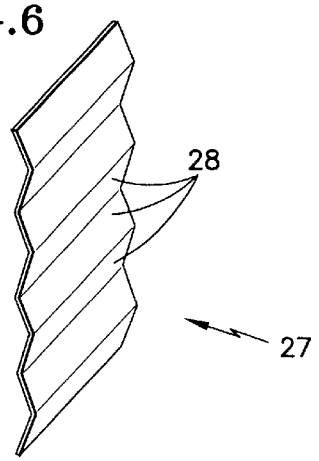
FIG. 6 is a perspective view of a section of a texture strip according to the present invention.

The output signal represented by 54 (FIGS. 3, 4, 5) of oscillator receiver 42 is based on return signal 46 and is processed by processor 52 to which oscillator receiver 42 is coupled. Output signal 54 is comprised of a broadened spectral line of overlapping frequencies as described above with respect to return signal 46. Among the frequencies in signal 54 is a direct current (DC) bias and an alternating current (AC) that carries the information pertaining to the speed of the elevator car 2 along with noise and other various frequencies. Processor 52 blocks the DC portion of output signal and is further used to determine the average AC frequency of output signal 54 pertaining to the velocity of elevator car 2. An alternative embodiment of the present invention is shown in FIG. 6 as textured strip 27 disposed on rail 14 or wall 18 and used in conjunction with speed sensor 30*a* (FIG. 2). Textured strip 27 includes a uniform pattern of raised features 28 shown by way of example as simple lines. Textured strip 27 produces a return signal 46 having increased amount of backscatter thereby increasing the reflection and accuracy of the operation of the present invention. Texture strip 27 may be attached to rail 14 or wall 18 by any suitable means. In another alternative embodiment a uniform pattern of raised features may be embossed directly into rail 14 during its manufacture or produced directly onto wall 18.

Referring now to FIG. 3, there is shown an embodiment of processor 52 suitable for use with speed sensor 30. Processor 52 is comprised of a low-pass filter 56 to eliminate high-frequency noise and a limiter 58 to stabilize the amplitude of output signal 54. The frequency of output signal 54 is estimated by use of a commercially available frequency to voltage converter 60 such as a LM2907 or LM2917 supplied by National Semiconductor Corporation.

Referring now to FIG. 4 an alternative embodiment processor 52 is shown comprised of filter 56, limiter 58 and phase-locked loop (PLL) 62. PLL consists of a voltage-controlled oscillator and a phase detector. The oscillator supplies a known signal to the phase detector and output signal 54 is similarly supplied to the phase detector. When the two signals are within some predetermined frequency of one another, the oscillator frequency will lock to (track) the input frequency 54. The technique permits realization of a narrow-band tracking filter. The control voltage supplied to the oscillator is proportional to its frequency which in turn is directly proportional to the velocity of the elevator car 2. An initial voltage is supplied to the oscillator corresponding to an overspeed condition of the elevator car. When the velocity of elevator car 2 reaches an overspeed condition the PLL will lock to the input frequency 54. A commercially available chip such as a model LN565 supplied by National may be useful for performing the PLL function.

Yet another alternative embodiment of processor 52 is shown in FIG. 5 and includes a filter 56 and an analog to digital converter 64 (A/D) for digitizing output signal 54. Processor 52 further includes a digital signal processor 66 (DSP) which utilizes the digitized version of output signal 54 to determine the Doppler signal corresponding to an overspeed condition of elevator car 2 using a Fast Fourier Transform.

Processor 52 produces an output speed signal 68 which as described herein relates to the velocity and direction of elevator car 2. Output speed signal 68 is used by speed detection module 70 to determine whether an overspeed condition exists utilizing software, a comparator or other equivalent means. In one embodiment of the present invention speed detection module 70 comprises a microprocessor may by included as a component of processor 52, a stand alone processor, or may be included in the main elevator processor (not shown). Speed detection module 70 compares speed signal 68 to a threshold voltage value corresponding to an overspeed condition. For example, an elevator may have a rated speed of 15 m/s and an overspeed condition is typically 120% +/−5% of the rated speed. Using the relation established herein above when the voltage of signal 68 corresponds to a threshold frequency greater than 2773.8 Hz, speed detection module 70 outputs signal 72 to trigger the operation of actuator 34 (FIG. 1) and the safety brake system as described herein above.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An elevator speed detection system comprising:

a speed sensor system detecting a speed of an elevator car and generating a speed signal wherein the speed sensor system comprises:

a transmitter directing a transmitted signal;

a receiver receiving a return signal; and a processor receiving the return signal from the receiver and producing the speed signal; and a speed detection module producing an output signal corresponding to the speed of the elevator car.

2. The elevator speed detection system of claim 1 wherein the transmitter and receiver comprises a radar device and further includes an antenna.

3. The elevator speed detection system of claim 1 wherein the processor comprises:

a filter;

a limiter; and a frequency to voltage converter or a phase-locked loop.

4. The elevator speed detection system of claim 1 wherein the processor comprises:

a filter;

an analog to digital converter; and a digital signal processor.

5. The elevator speed detection system of claim 1 wherein the transmitter and receiver are mounted to a top or a bottom of the elevator car within a hoistway.

6. The elevator speed detection system of claim 5 wherein the hoistway includes a wall and a rail and the transmitted signal is directed at the wall or the rail.

7. The elevator speed detection system of claim 5 further comprising a uniform pattern disposed on the wall or the rail and wherein the transmitted signal is directed at the uniform pattern.

8. The elevator speed detection system of claim 5 wherein the hoistway includes a ceiling and a bottom and wherein the transmitted signal is directed at the ceiling or the bottom.

9. The elevator speed detection system of claim 1 wherein the elevator car is disposed within a hoistway and wherein the transmitter and receiver are mounted within the hoistway and the transmitted signal is directed at the elevator car.

10. The elevator speed detection system of claim 1 further comprising the speed detection module comparing the speed signal to a threshold speed and producing an overspeed signal corresponding to an overspeed condition.

11. An elevator system having an elevator car and a safety braking system disposed on the elevator car for emergency stopping of the elevator car, the elevator system comprising:

a speed sensor system detecting a speed of an elevator car and generating a speed signal;

a speed detection module comparing the speed signal to a threshold speed and producing an overspeed signal corresponding to an overspeed condition; and an actuator receiving the overspeed signal and activating the safety brake system.

12. The elevator system of claim 11 wherein the speed sensor system comprises:

a transmitter directing a transmitted signal;

a receiver receiving a return signal; and a processor receiving the return signal from the receiver and producing the overspeed signal.

13. The elevator system of claim 12 wherein the transmitter and receiver comprises a radar device and further includes an antenna.

14. The elevator system of claim 12 wherein the processor comprises:

a filter;

a limiter; and a frequency to voltage converter or a phase-locked loop.

15. The elevator system of claim 12 wherein the processor comprises:

a filter;

an analog to digital converter; and a digital signal processor.

16. The elevator system of claim 12 wherein the transmitter and receiver are mounted to a top or a bottom of the elevator car within a hoistway.

17. The elevator system of claim 16 wherein the hoistway includes a wall and a rail and the transmitted signal is directed at the wall or the rail.

18. The elevator system of claim 17 further comprising a uniform pattern disposed on the wall or the rail and wherein the transmitted signal is directed at the uniform pattern.

19. The elevator system of claim 16 wherein the hoistway includes a ceiling and a bottom and the transmitted signal is directed at the ceiling or the bottom.

20. The elevator system of claim 12 wherein the elevator car is disposed within a hoistway and wherein the transmitter and receiver are mounted within the hoistway and the transmitted signal is directed at the elevator car.

21. A method of actuating the safety braking system of an elevator car comprising:

sensing a speed of the elevator car;

generating a speed signal;

comparing the speed signal to a threshold speed to generate an overspeed signal; and actuating the safety braking system if the overspeed speed signal indicates a car speed greater than the threshold speed.

22. The method of detecting of claim 21 wherein the elevator car has a top and a floor and is disposed within a hoistway having a ceiling, a bottom, a wall and a rail, and wherein the sensing comprises:

directing a transmitted signal at the ceiling, the bottom, the wall, the rail, the top or the bottom; and receiving a return signal.

* * * * *